United States Patent [19]

Röck et al.

[11] 4,138,766

[45] Feb. 13, 1979

[54] HINGE WITH A LOCKING DEVICE

[75] Inventors: Erich Röck, Höchst; Bernhard Mages, Dornbirn, both of Austria

[73] Assignee: Julius Blum Gesellschaft m.b.H., Höchst, Austria

[21] Appl. No.: 851,586

[22] Filed: Nov. 14, 1977

[30] Foreign Application Priority Data

Nov. 23, 1976 [AT] Austria ..... 8701/76

[51] Int. Cl.[2] ..... E05D 11/10; E05D 3/06

[52] U.S. Cl. ..... 16/145; 16/163

[58] Field of Search ..... 16/145, 147, 163, 164, 16/180, 182, 183, 50

[56] References Cited

U.S. PATENT DOCUMENTS

| | | | |
|---|---|---|---|
| 3,940,828 | 3/1976 | Lautenschlaeger | 16/163 |
| 4,050,116 | 9/1977 | Salice | 16/164 X |

FOREIGN PATENT DOCUMENTS

| | | | |
|---|---|---|---|
| 2408057 | 8/1975 | Fed. Rep. of Germany | 16/145 |
| 2524504 | 12/1976 | Fed. Rep. of Germany | 16/163 |

*Primary Examiner*—James Kee Chi

*Attorney, Agent, or Firm*—Wenderoth, Lind & Ponack

[57] ABSTRACT

A hinge for furniture doors includes a hinge casing and a hinge arm which are interconnected by means of hinge links. A locking device is integrated in the hinge and has a pressure member which by the force of a spring is pressed to one side of the hinge arm the, direction of movement of the pressure member being parallel to the axles of the hinge links.

7 Claims, 11 Drawing Figures

HINGE WITH A LOCKING DEVICE

BACKGROUND OF THE INVENTION

1. Field of the Invention

The present invention relates to a hinge with a locking device in which a hinge arm is connected with a second hinge part, e.g. a hinge casing or the like, preferably by means of two hinge links forming a quadrangular linkage and in which acts on a pressure lever which closing pressure is exerted by a spring which rests on at least one of the hinge links.

2. Description of the Prior Art

Hinges having an arrangement of hinge axles and hinge links, as mentioned above, have more and more frequently been used for furniture doors, wherein one hinge part usually has the shape of a casing which can be inserted into a recess of the furniture door, and wherein the second hinge part is a hinge arm which can be mounted, preferably adjustably on the side wall inside the piece of furniture.

By providing such hinges with springs, a closing pressure is exerted on the door when the hinge is closed. Suggestions which have been made so far are not satisfactory, especially because of the great strain on some parts of the hinge over an excessively long period of time. The working life of these hinges is, therefore, relatively short.

It is a further disadvantage of many hinges according to the prior art that the closing pressure is exerted in any position the door is in, including when the door is completely open.

Therefore, one demand which is made regarding the above-mentioned hinges is that the closing pressure be exerted only when the door is closed, or almost closed so that doors which are not carefully completely closed will also be closed automatically by the hinge. The door is considered as almost closed if there is an angle of approximately 10–15 degrees between the actual door position and the plane of the closed door.

SUMMARY OF THE INVENTION

It is an object of the present invention to produce a hinge of the above-mentioned kind which distinguishes most exactly between positions where closing pressure is exerted and positions where the hinge can be pivoted without being influenced by the spring pressure. It is a further object of the present invention to produce a snap mechanism or spring mechanism of extremely compact construction so that parts which are necessary for adjusting the hinge, e.g. the adjusting screw for the adjustment of the door gap, can be mounted in the hinge arm.

It is a further object of the present invention to produce a hinge in which the pressure level is constructed in such a way that the closing pressure can be varied.

According to the present invention these objects are achieved by providing the pressure level and the hinge link with corresponding oblique faces which rest on each other and by the fact that the pressure lever can be moved parallel to the axles of the hinge links against the resistance of the spring. It is preferably provided that the spring rests against a side web of the hinge arm which has a U-shaped profile in a conventional manner, thereby making a separate stop for the spring unnecessary.

A coil spring is particularly suitable as the spring, but a different kind of spring, e.g. a leg spring, could also be used.

In order to provide a range for the pivoting movement of the hinge which is not influenced by the spring pressure, a preferred embodiment of the invention provides that the pressure lever and the hinge link each have supporting surfaces which extend vertically with respect to the axles of the hinge links, which lie adjacent to the oblique faces, and which rest on each other when the hinge is open.

A further embodiment of the invention provides that the oblique face of this hinge link is positioned on an extension arm of the hinge link. This allows good utilization of space and moreover a good distribution of forces.

It is furthermore provided that the oblique face of the pressure lever is positioned between the oblique face of the hinge link and the axle of the hinge link.

A preferred embodiment furthermore provides that the pressure lever is movably mounted on at least one axle of the hinge link and preferably on two of them. If the pressure lever is mounted on two axles of the hinge links a correct parallel displacement is achieved when the pressure lever is shifted. This has proved to be of advantage driving tests. It is also possible, however, to mount the pressure lever in such a way that it makes a rotary movement when shifted alongside an axle, whereby a closing effect can in the same way be achieved on the hinge.

It is preferably provided that the pressure lever is mounted on the side of the hinge arm.

BRIEF DESCRIPTION OF THE DRAWINGS

In the following the invention will be described in more detail by means of the figures of the attached drawings without being limited to the illustrated embodiment.

DESCRIPTION OF THE PREFERRED EMBODIMENTS

Figure 1:
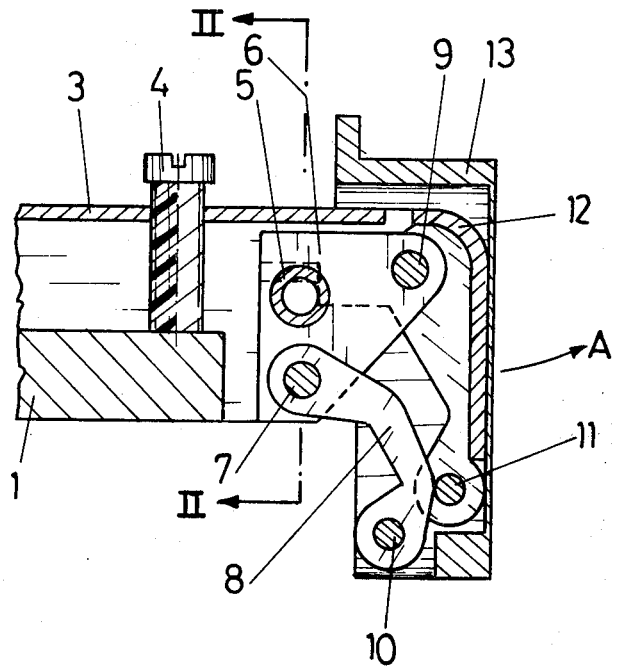
FIG. 1 is a longitudinal section, taken approximately along line I—I in FIG. 2, of a hinge according to the invention, in the closed position thereof.

The hinge according to the invention comprises a hinge part in the form of a hinge casing 13 which is to be inserted into a recess of the door 14. The other hinge part comprises a hinge arm 3 which is fixed to the side wall 15 of the piece of furniture by means of a mounting plate 1. Two hinge axles 10, 11 are mounted on the hinge casing 13 and two further hinge link axles 7, 9 are mounted on the hinge arm 3. The hinge axles 7, 9 and 10, 11 are linked to each other by means of hinge links 8 and 12.

The hinge link 12 has an extension arm 12' having a free end provided with an oblique face 16. The oblique face 16 is inclined to the hinge axles 7, 11 at an angle $\alpha$. As can particularly be seen in FIGS. 1, 2 and 4 a pressure lever 6 is mounted on the hinge axles 7 and 9, which means that the pressure lever 6 is eccentrically positioned with respect to the longitudinal center plane of the hinge arm 3 and between the hinge link 12, forming the outer hinge link, and the hinge link 8, forming the inner hinge link.

Figure 2:
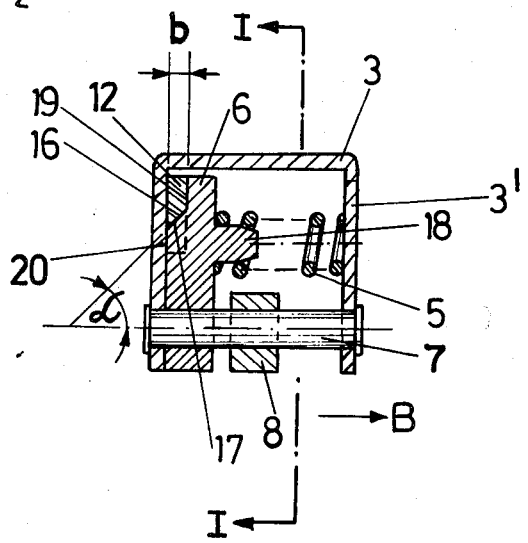
FIG. 2 is a section taken along the line II—II of FIG. 1.

The pressure lever 6 also has an oblique face 17 which corresponds to the oblique face 16 of the hinge link 12, so that the two oblique faces 16 and 17 rest on each other when the hinge is closed as can be seen in FIG. 2.

Figure 4:
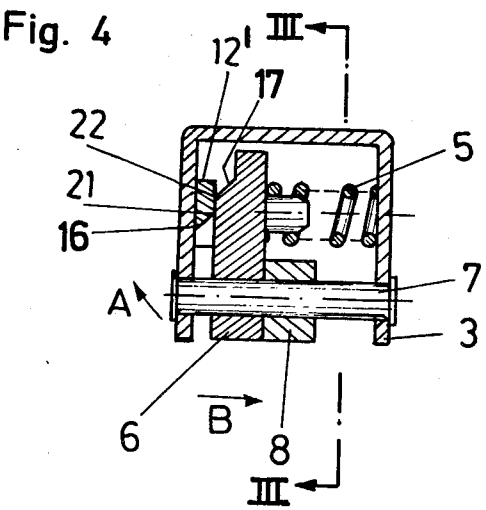
FIG. 4 is a section along the line IV—IV of FIG. 3.
Figure 3:
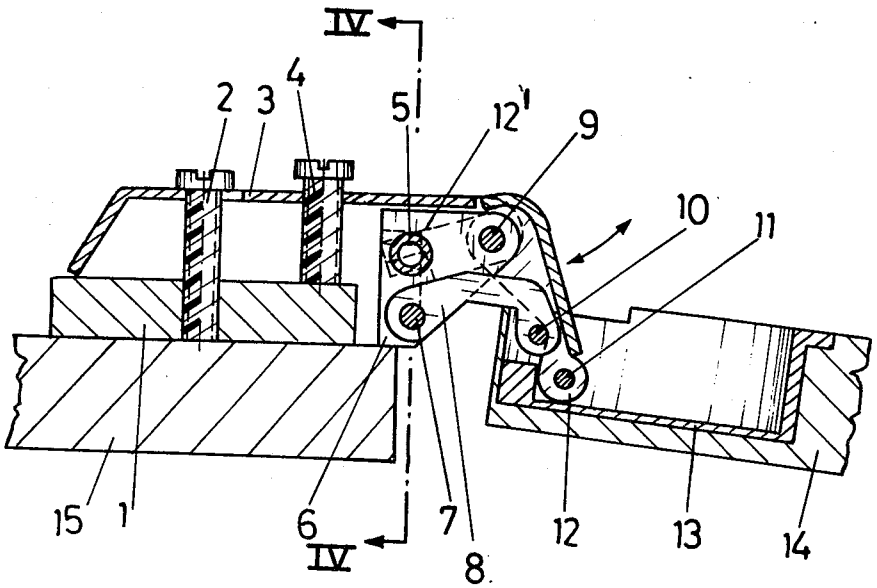
FIG. 3 is a longitudinal section, taken approximately along line III—III in FIG. 4, of a hinge according to the invention, in the open position thereof.
Figure 5A:
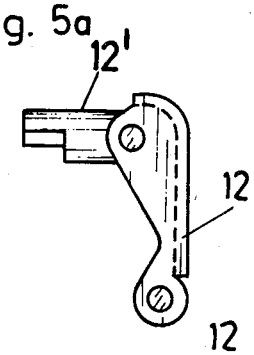
FIGS. 5*a*, 5*b* and 5*c* are respectively a side view, a top view and an end view of a hinge link which acts together with a pressure lever according to the invention.
Figure 5C:
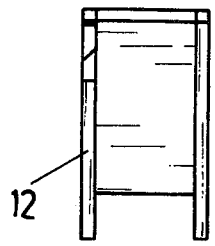
Figure 5B:
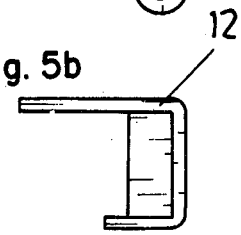
Figure 6A:
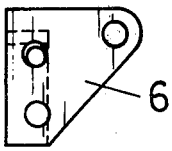
FIGS. 6*a*, 6*b* and 6*c* are respectively a side view, a top view and an end view of a pressure lever according to the invention.
Figure 6C:
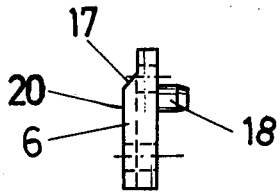
Figure 6B:
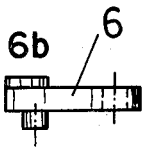
Figure 7:
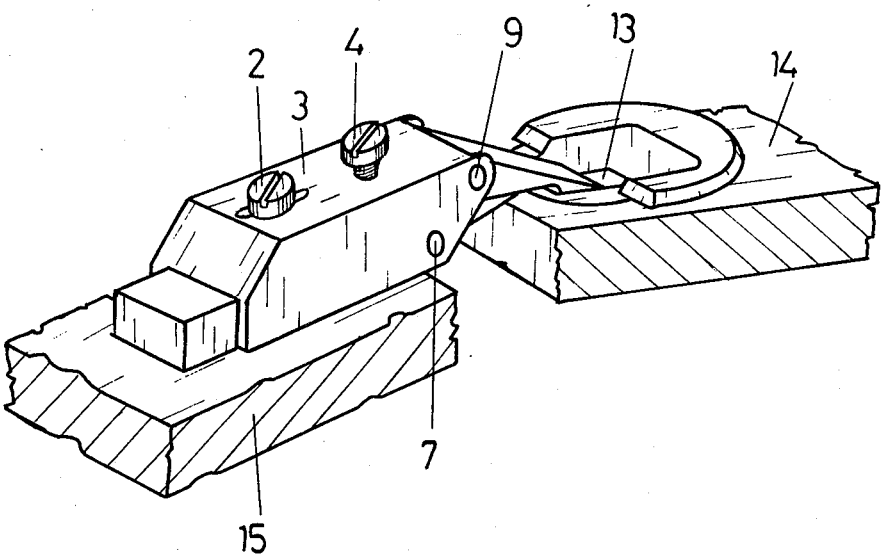
FIG. 7 is a perspective view of a hinge according to the invention.

The pressure lever 6 which is movably mounted on the hinge axles 7 and 9 is under the pressure of a coil spring 5 against a side wall 3' of the hinge arm 3 and an other end which rests against the pressure lever 6, whereby a holding base 18 is provided on lever 6 to keep the spring 5 in position (FIG. 2, FIG. 4).

If the hinge is in a closed position and the door 14 is then opened, the hinge link 12 is turned around the hinge axle 9 in the direction of arrow A (FIG. 1). Thereby the oblique face 16 is pressed against the oblique face 17 of the pressure lever 6, and pressure lever 6 is shifted in the direction of arrow B (FIG. 2, FIG. 4) by a wedging effect. When the pressure lever 6 has been shifted over the width b of the extension arm 12' in the direction of arrow B, the lateral supporting surface 19 of the extension arm 12' rests against the lateral supporting surface 20 of the pressure lever 6, whereby both supporting surfaces 19, 20 form a right angle with the hinge axles 7 and 9. Thus no further shifting of the pressure lever 6 occurs and the extension arm 12' and the hinge link 12 are, apart from mere friction, freely movable onto the position in which the hinge is opened as wide as possible.

When the hinge is closed the spring 5 does not influence the closing process (apart from friction) until the edge 21 of the extension arm 12' reaches the edge 22 of the pressure lever 6. Then the spring 5 pushes the pressure lever 6 back on the hinge axle 7 and 9 in a in the direction opposite to arrow B, and pressure lever 6 presses by means of the wedging effect the extension arm 12' in the direction of arrow A' (FIG. 4), which means in a direction opposite to arrow A.

In the illustrated embodiment, the hinge arm 3 is fixed to the mounting plate 1 by means of the fastening screw 2 and to the side wall 15 of the piece of furniture by means of the mounting plate 1. The way in which the mounting plate 1 is fastened and the possibility of adjusting the hinge arm 3 with respect to the mounting plate 1 are not described in detail as they do not in and of themselves form a portion of the invention. In the figures of the drawings an adjusting screw 4 for an adjustment in the door joint is illustrated, however, and it is of importance that in the hinge according to the invention screw 4 can be positioned extremely near to the end of the hinge arm 3 adjacent to the door.

We claim:

1. A hinge comprising:

a hinge arm;

a hinge casing;

a first hinge link having first and second opposite ends, said first end of said first link being connected to said hinge arm by a first axle, and said second end of said first link being connected to said hinge casing by a second axle;

a second hinge link having first and second opposite ends, said first end of said second link being connected to said hinge arm by a third axle, and said second end of said second link being connected to said hinge casing by a fourth axle;

said first and second links cooperating to form a quadrangular linkage connecting said hinge casing to said hinge arm, such that said hinge casing is movable about said quadrangular linkage between an open position and a closed position;

one of said hinge links having a first oblique surface which extends in a plane which is non-parallel to the axes of said axles;

a pressure lever having a second oblique surface which is complementary to said first oblique surface and which extends in a plane which is non-parallel to said axes of said axles;

said pressure lever being mounted for sliding movement axially of at least one of said first and third axles between a first position at which said first and second oblique surfaces are aligned and in mutual contact, thereby retaining said hinge casing in said closed position thereof, and a second position at which said first and second oblique surfaces are out of alignment and mutual contact;

spring means operatively positioned for urging said pressure lever from said second position thereof to said first position thereof; and movement of said hinge casing from said closed position thereof to said open position thereof causing said first oblique surface of said one hinge link to be cammed against said second oblique surface of said pressure lever, thereby moving said pressure lever from said first position thereof to said second position thereof against the force of said spring means.

2. A hinge as claimed in claim 1, wherein said spring means comprises a coil spring.

3. A hinge as claimed in claim 2, wherein said hinge arm has a U-shaped profile including a pair of spaced side walls joined by a web, and said coil spring has a first end positioned against one of said side walls and a second end positioned against said pressure lever.

4. A hinge as claimed in claim 3, wherein said pressure lever has an integral holding base for maintaining the position of said second end of said coil spring.

5. A hinge as claimed in claim 1, wherein said one hinge link has adjacent said first oblique surface thereof a first lateral surface extending transverse to said axes of said axles, and said pressure lever has adjacent said second oblique surface thereof a second lateral surface extending transverse to said axes of said axles, said first and second lateral surfaces being in contact when said pressure lever is in said second position thereof and when said hinge casing is in said open position thereof.

6. A hinge as claimed in claim 1, wherein said one hinge link has an integral extension arm, and said first oblique suface is on said extension arm.

7. A hinge as claimed in claim 1, wherein said pressure lever is mounted laterally of said one hinge arm.

* * * * *